US006133518A

United States Patent [19]

Kamimura et al.

[11] Patent Number: 6,133,518

[45] Date of Patent: Oct. 17, 2000

[54] COMPOSITION OF RESIN FOR LIGHT TRANSMITTING KEYS OF A MUSICAL KEYBOARD INSTRUMENT

[75] Inventors: Norizo Kamimura, Tokorozawa; Iwao Tomita, Ome, both of Japan

[73] Assignee: Casio Computer Co., Ltd., Tokyo, Japan

[21] Appl. No.: 09/340,360

[22] Filed: Jun. 28, 1999

[30] Foreign Application Priority Data

Sep. 30, 1998 [JP] Japan ..... 10-291311

[51] Int. Cl.[7] ..... G10C 3/12

[52] U.S. Cl. ..... 84/423 R; 84/477 R; 84/478

[58] Field of Search ..... 84/423 R, 433, 84/452 R, 452 P, 470 R, 477 R, 478

[56] References Cited

U.S. PATENT DOCUMENTS

| | | | |
|---|---|---|---|
| 2,811,072 | 10/1957 | Isaacson | 84/477 R |
| 3,420,135 | 1/1969 | Wolf | 84/478 |
| 3,731,582 | 5/1973 | Gullickson | 84/478 |
| 4,314,499 | 2/1982 | Olsen | 84/485 R |
| 4,346,639 | 8/1982 | Vagias | 84/437 |
| 4,730,533 | 3/1988 | Schoerkmayr | 84/478 |
| 4,840,104 | 6/1989 | Ishida et al. | 84/437 |
| 5,223,652 | 6/1993 | Ishida et al. | 84/427 |
| 5,266,515 | 11/1993 | Calabrese et al. | 84/437 |
| 5,557,055 | 9/1996 | Breitweiser, Jr. | 84/478 |
| 5,621,028 | 4/1997 | Lichtenstein et al. | 524/91 |
| 5,841,051 | 11/1998 | Segan | 84/477 R |

OTHER PUBLICATIONS

Patent Abstracts of Japan, vol. 1996, No. 09, Sep. 30, 1996 (Sep. 30, 1996) and JP 08–123408 A (Yamaha Corp.), May 17, 1996 (May 17, 1995)—Abstract.

Encyclopedia Britannica (15th edition), vol. 16, pp. 595–598, and vol. 7, p. 576, 1994.

Bass, M.: "Handbook of Optics." McGraw–Hill, Inc., sections 25.2, 25.3 and 25.4, 1995.

Besancon, R.M.: "The Encyclopedia of Physics." Van Nostrand Reinhold, New York, pp. 920 and 1133, 1990.

*Primary Examiner*—Robert E. Nappi
*Assistant Examiner*—Kimberly Lockett
*Attorney, Agent, or Firm*—Frishauf, Holtz, Goodman, Langer & Chick, P.C.

[57] ABSTRACT

A keyboard, having a plurality of keys arranged so as to be pivotable upward and downward and a plurality of light emitters arranged under the keys in one-to-one correspondence therewith, selectively causes the light emitters to emit light, thereby teaching keys to be depressed. A base resin, which forms each of the plurality of keys, has transparency and contains a pigment which colors the base resin and a light scattering agent having a light diffusion property. By virtue of the use of the pigment and the light scattering agent, a surface color which confers a refined feature on the keys can be realized, and accordingly a product with an excellent appearance can be attained. Moreover, by virtue of the blending of the pigment and the light scattering agent, the keys can shine uniformly without a difference in brightness when their corresponding light emitters are lighted, and a keyboard instrument player can fully recognize by his/her eyes that the keys shine.

7 Claims, 12 Drawing Sheets

HUE(XYZ) OF WHITE KEYS

COMPOSITION OF MIXTURE FOR BLACK KEYS

HUE(XYZ) OF BLACK KEYS

COMPOSITION OF RESIN FOR LIGHT TRANSMITTING KEYS OF A MUSICAL KEYBOARD INSTRUMENT

BACKGROUND OF THE INVENTION

1. Field of the Invention

The present invention relates to a keyboard for a keyboard instrument such as an electronic piano, and more particularly to a keyboard having keys, whose base resin contains a pigment and a light scattering agent, and light emitters incorporated in the keyboard. By virtue of the use of the pigment and the light scattering agent, a surface color which confers a refined feature on the keys can be realized, and accordingly a product with an excellent appearance can be attained. Furthermore, by virtue of the blend of the pigment and the light scattering agent, the keys can shine uniformly without a difference in brightness when the light emitters are lighted up, and the keyboard instrument player can fully recognize that the keys shine.

2. Description of the Related Art

A keyboard instrument with a navigator function has been developed conventionally, in which a plurality of keys are arranged so as to be pivotable upward and downward, a plurality of light emitters are arranged under the distal end portions or middle portions of their corresponding keys, and the light emitters are selectively lighted up in accordance with music pre-stored in a memory, thus teaching which keys are to be depressed. Keyboard instruments of this type are disclosed in, for example, U.S. Pat. No. 4,730,533, the contents of which are herein incorporated in its entirety by reference.

The plurality of keys on the keyboard of the above-described keyboard instrument include white and black keys, each of which is made of a synthetic resin having a light transmitting property. When the lower surfaces of the keys are illuminated with the light emitted from the light emitters arranged under the keys, part of the illumination light passes through the keys so that the keys are seen bright.

However, in the keyboard of such a keyboard instrument, the light emitters can be viewed through the keys when the light transmittance of the keys is high. The appearance of such a product is not excellent and has a drawback in that the value of the product is lowered accordingly. In contrast, when the light transmittance of the keys is low, the light emitted from the light emitters cannot easily pass through the keys, which entails a drawback in that the keys cannot shine satisfactorily bright. In the case where the luminance of the light emitters is set high in order to permit the keys to shine satisfactorily bright, there is a drawback in that the power consumption is increased.

SUMMARY OF THE INVENTION

It is accordingly an object of the present invention to provide a keyboard with an excellent appearance and which has been designed so that the keys can shine satisfactorily bright when their corresponding light emitters are lighted.

According to the first aspect of the present invention, there is provided a keyboard having a plurality of keys being pivotable upward and downward and a plurality of light emitters arranged under the plurality of keys, the keyboard selectively causing the plurality of light emitters to emit light, thereby teaching which keys are to be depressed, wherein each of the plurality of keys comprises a base resin having transparency and containing a pigment which colors the base resin and a light scattering agent having a light diffusion property.

Each white key may have a transmittance which has been set at 6% or higher, while each black key may have a transmittance which has been set at 1% or higher. In this case, the keyboard instrument player can fully recognize by his/her eyes that the white and black keys shine when their corresponding light emitters are lighted.

Each of the white and black keys may have a haze of 70% or higher which represents a degree of cloudiness due to a diffusion of light. In this case, the white and black keys can shine uniformly without a difference in brightness, while the light emitters can be prevented from being viewed through the white and black keys.

Each white key may have a hue which is specified by a chromaticity coordinate x of 0.303 or greater and a chromaticity coordinate y of 0.308 or greater in an XYZ color system, while each black key may have a hue which is specified by a chromaticity coordinate x of 0.310 or greater and a chromaticity coordinate y of 0.315 or greater. In this case, a surface color which confers a refined feature on the white and black keys can be realized, and accordingly a product with an excellent appearance can be attained.

By satisfying each of the above-described conditions, the optimum white and black keys, which are excellent in terms of surface color, recognizability and uniform diffusion property, can be attained.

Furthermore, each of the light emitters arranged under the white keys may have an illuminance equal to or higher than 70 luxes, while each of the light emitters arranged under the black keys may have an illuminance equal to or higher than 12 luxes. In this case, the keyboard instrument player can fully recognize by his/her eyes even in daylight that the white and black keys shine.

DETAILED DESCRIPTION OF THE PREFERRED EMBODIMENT

An electronic keyboard instrument employing a keyboard according to one embodiment of the present invention will now be described with reference to FIGS. 1 to 12.

Figure 1:
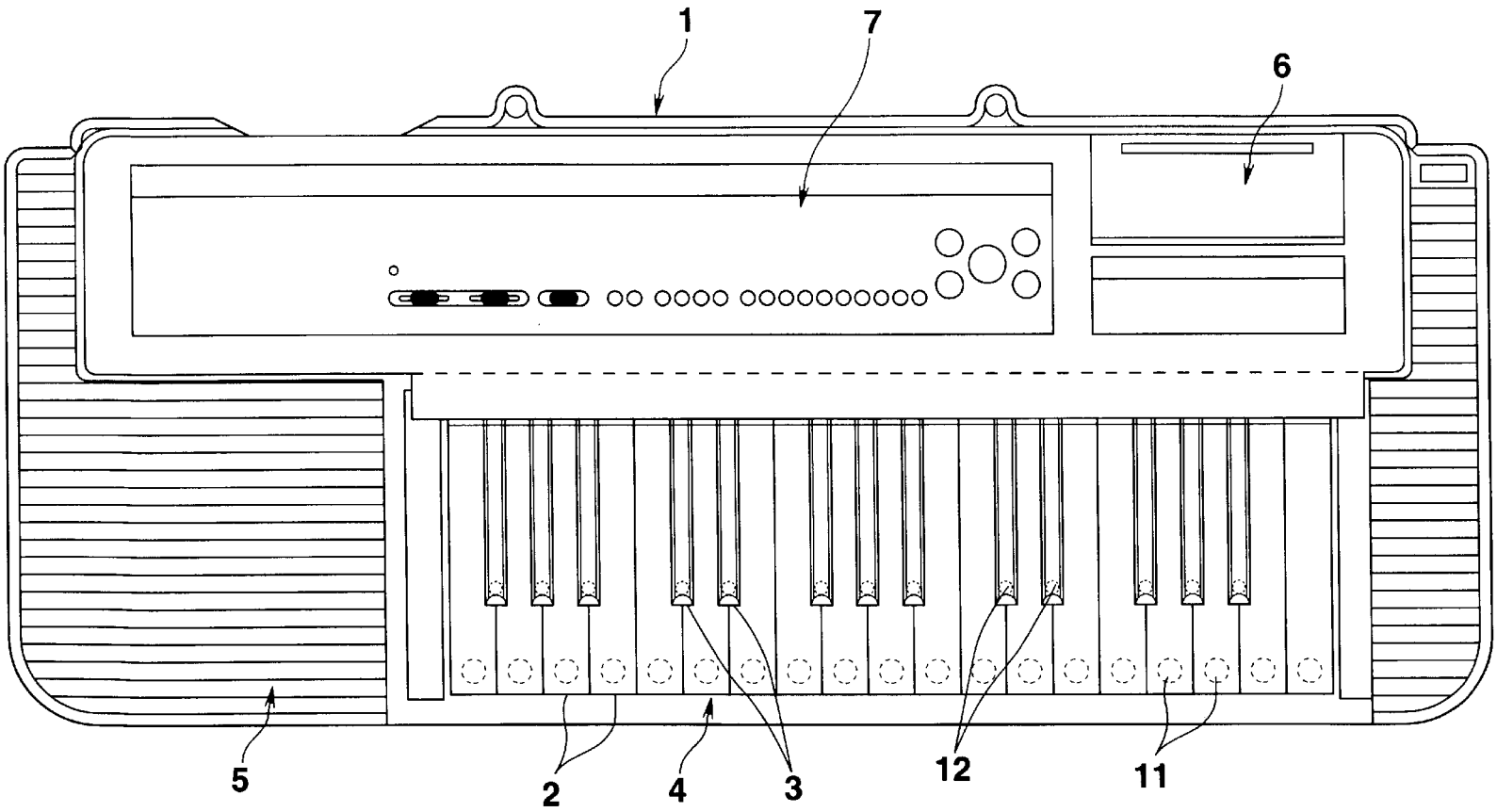
FIG. 1 is a plan view of an electronic keyboard instrument employing a keyboard according to one embodiment of the present invention.

FIG. 1 is a plan view of the electronic keyboard instrument. This electronic keyboard instrument comprises a keyboard 4 having a plurality of keys (white keys 2 and black keys 3) arranged on an instrument case 1, a speaker portion 5 which outputs a musical sound, an external storage portion 6 in which an external storage device such as a ROM pack is inserted, and a switch portion 7 having various switches. The switch portion 7 is provided with a variety of switches such as a mode select switch, a tone select switch, a rhythm select switch, a volume select switch, an automatic performance select switch and a step select switch. The automatic performance select switch is a switch for automatically playing music and causing the keys to emit light in accordance with the music while being played. The step select switch is a switch for selecting a step according to level such as an expert, intermediate or beginner level.

Figure 2:
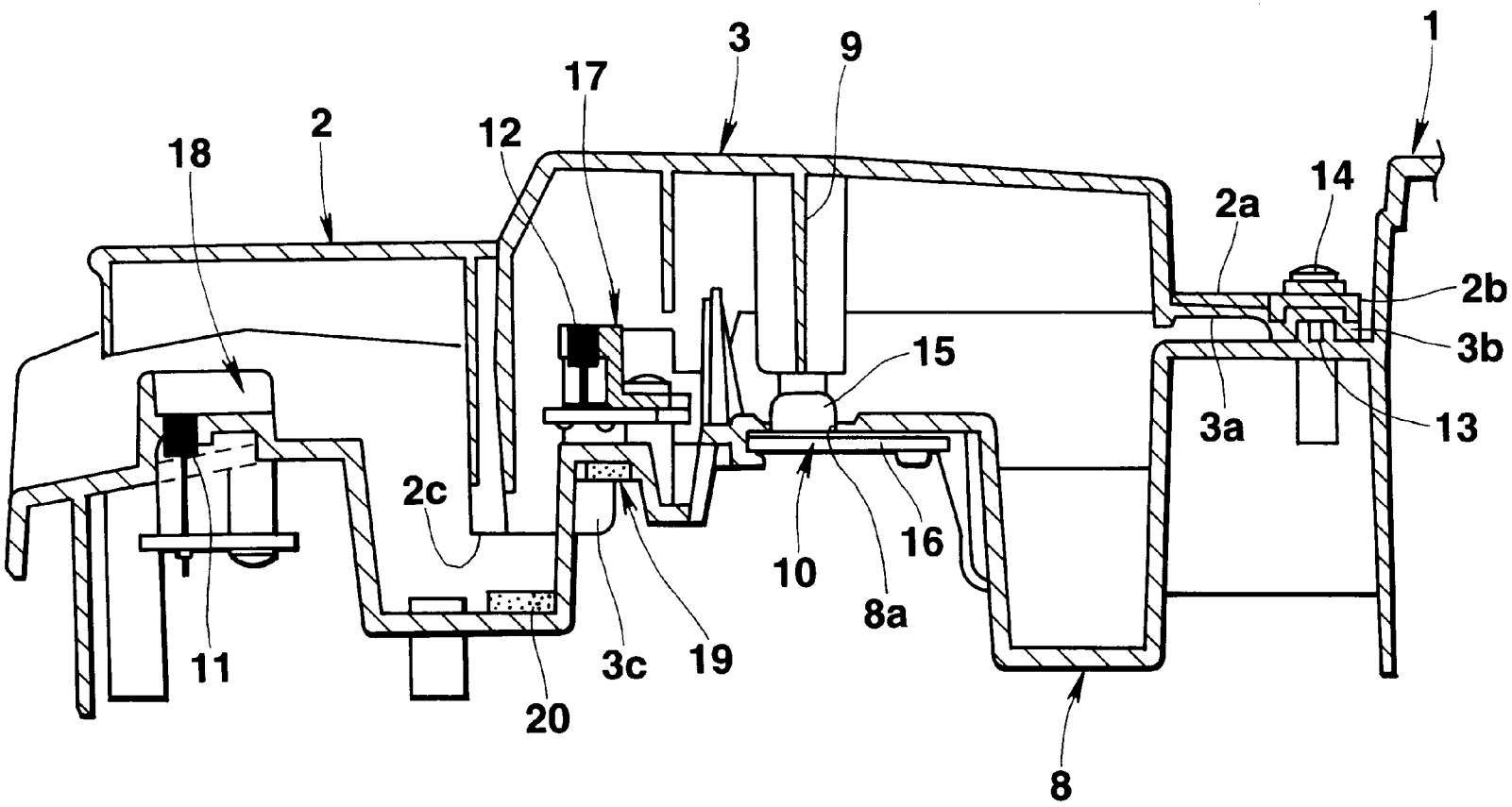
FIG. 2 is an enlarged sectional view of the main part of the keyboard illustrated in FIG. 1.

As illustrated in FIG. 2, the keyboard 4 comprises: a keyboard chassis 8 formed inside the instrument case 1 in integration therewith; white keys 2 and black keys 3 formed on the keyboard chassis 8 so as to be pivotable upward and downward; rubber switch portions 10 which are pressed by their corresponding pressing portions 9 of the respective white and black keys 2 and 3 when those keys are depressed; and light emitters 11 for the white keys and light emitters 12 for the black keys, the light emitters 11 and 12 being arranged under the distal end portions of the white and black keys 2 and 3 in one-to-one correspondence with those keys.

Each black key 3 has a thin portion 3*a* at its proximal end (on the right side of FIG. 2). The thin portions 3*a* of the black keys 3 are formed in integration with each other by being formed so that the thin portions 3*a* are coupled in the state of being parallel with each other at their proximal ends to a common coupling portion 3*b* extending in the direction of arrangement of the keys. Similarly, each white key 2 has a thin portion 2*a* at its proximal end (on the right side of FIG. 2), and the thin portions 2*a* of the white keys 2 are formed in integration with each other by being formed so that the thin portions 2*a* are coupled in the state of being parallel with each other at their proximal ends to a common coupling portion 2*b* extending in the direction of arrangement of the keys. The coupling portions 2*b* and 3*b* for the white and black keys 2 and 3 are attached by a screw 14 onto an attachment portion 13 which is located on the proximal end portion of the keyboard chassis 8.

The rubber switch portions 10 have their respective elastically deformable swelled rubbers 15, which are in one-to-one correspondence with the white and black keys 2 and 3, and which are arranged on a circuit board 16 provided under the lower surface of the middle part of the keyboard chassis 8. The rubber switch portions 10 are designed as follows: a fixed contact and a movable contact being movable toward and away from the fixed contact, are provided in each of the swelled rubbers 15, which project upward through their corresponding apertures 8*a* formed in the keyboard chassis 8, while the pressing portions 9 of the white and black keys 2 and 3 abut against the upper ends of the swelled rubbers 15 and are pushed up by the elastic restoration forces of the swelled rubbers 15.

The light emitters 12 for the black keys are attached to their corresponding light source holders 17 arranged above the keyboard chassis 8 so as to be located under the distal end portions of the black keys 3. Each of the light emitters 12 for the black keys comprises a high luminance light emitting diode (LED). The inner surfaces of the distal end portions of the black keys 3 are illuminated with the light emitted from the light emitters 12. In this case, the light emitters 12 for the black keys emit light having an illuminance equal to or higher than 12 luxes, for example, and the light emitters 12 are set so that the inner surfaces of the black keys 3 are illuminated with the light emitted therefrom. Similarly, the light emitters 11 for the white keys, each of which emitters comprises a high luminance LED, are attached to their light source holders 18 arranged above the keyboard chassis 8 so as to be located under the distal end portions of the white keys 2, and the inner surfaces of the distal end portions of the white keys 2 are illuminated with the light emitted from the light emitters 12. In this case, the light emitters 11 for the white keys emit light having an illuminance equal to or higher than 70 luxes, for example, and the light emitters 12 are set so that the inner surfaces of the white keys 2 are illuminated with the light emitted therefrom.

Upper-limit stoppers 19, which are made of a felt or the like, are arranged under the lower surface of the middle portion of the keyboard chassis 8. The white keys 2 and the black keys 3 are pushed up by the elastic restoration forces of the swelled rubbers 15 and the elastic restoration forces of the thin portions 2*a* and 3*a* such that the L-shaped stopper pieces 2*c* and 3*c* of the white and black keys 2 and 3 abut against the upper stoppers 19, restricting the white and black keys 2 and 3 to their predetermined upper positions (initial positions). Furthermore, lower-limit stoppers 20, which are made of a felt or the like, are arranged on that part of the keyboard chassis 8 which is located under the L-shaped stopper pieces 2*c* and 3*c*.

Each of the white and black keys 2 and 3 comprises a base resin having transparency, a pigment which colors the base resin, and a light scattering (diffusing) agent having a light diffusion property in order to permit part of the light emitted from the light emitters 11 and 12 to transmit and brighten the white and black keys 2 and 3 themselves.

Polystyrene (PS), polymethyl methacrylate(PMMA), polycarbonate (PC), AS resin (styrene-acrylonitrile resin), ABS resin (acrylonitrile-butadien-styrene resin) or the like can be adopted as the base resin. However, HI polystyrene which is produced by adding styrene-butadiene rubber (SBR) to polystyrene in order to improve the shock resistance, is especially preferred as the base resin. Alternatively, a blend of general purpose polystyrene (GP) and HI polystyrene can also be adopted as the base resin.

In the white keys 2, titanium oxide for producing the color white is used as the pigment, while in the black keys 3, black carbon for producing the color black is used as the pigment.

An inorganic- or organic-series diffusion agent or a matting agent is available as the light scattering agent. An organic-series matting agent is preferred. Synthetic rubber such as SBR can be used as the matting agent.

The surface colors, the light transmission properties and the diffusion properties of the white and black keys 2 and 3 are influenced by the blending of the pigment and the light scattering agent into in the base resin. That is, in the case of the white keys 2, if the amount of pigment to be added is increased to attain yellowish, ivory white, the white keys 2 cannot transmit light. If the amount of pigment to be added is decreased to improve the light transmittance, the surface color will become similar to the color of the base resin and consequently the keys 2 will not be the "white" keys. The same applies to the black keys 3. Bluish black is preferred in the case of the black keys 3.

The conditions for blending the pigment and the light scattering agent for the white keys 2, as well as the pigment and the light scattering agent for the black keys 3, will now be described.

First, the white keys 2 will be explained with reference to FIGS. 3 to 7.

Figure 3:
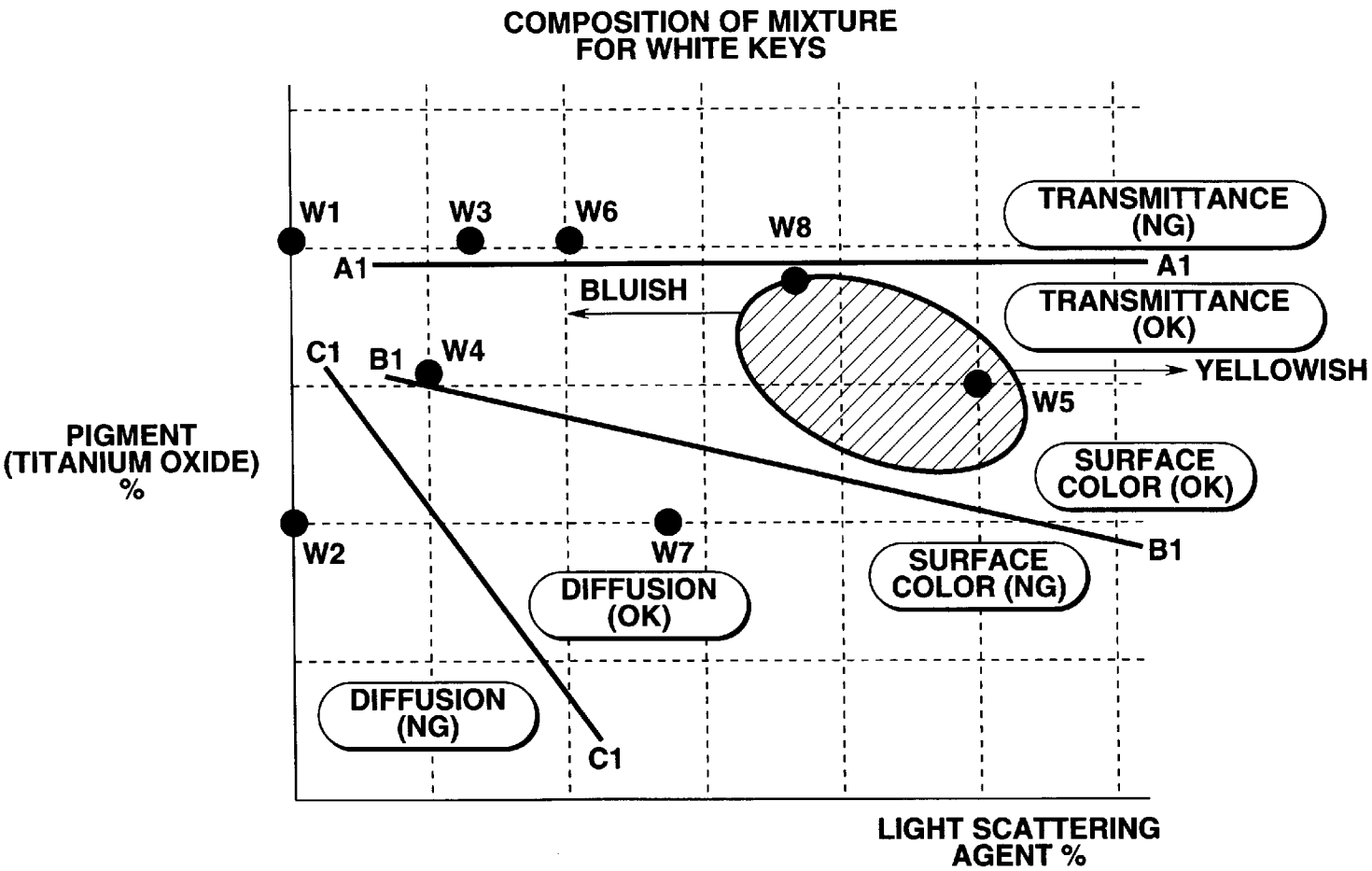
FIG. 3 is a diagram demonstrating the composition of the mixture of a pigment and a light scattering agent for white keys illustrated in FIG. 2.

FIG. 3 demonstrates the composition of the mixture of the pigment and the light scattering agent for the white keys 2, and shows the relationship between the amount (%) of added light scattering agent which is plotted against the axis of abscissas, and the amount (%) of added pigment (titanium oxide) which is plotted against the axis of ordinates. In FIG. 3, given points W1 to W8 were selected as sample points, and the light transmittance (i.e. the percentage of light rays passing through a key to light rays entering the key), the haze (the value representing the degree of cloudiness due to the diffusion of light) and the hue were measured at the sample points W1 to W8. The light transmittance was observed in terms of the total light transmittance Tt (=Td+Tp), the diffuse transmittance Td and the parallel light transmittance Tp. The total light transmittance Tt indicates the percentage of the total outgoing flux coming out from the key to the total incoming flux entering the key. The diffuse transmittance Td indicates the percentage of diffused light rays refracted while passing through the key to the total incoming flux. The parallel light transmittance Tp, which is the remainder as a result of the subtraction of the diffuse transmission Td from the total light transmission Tt, indicates the percentage of parallel light rays passing through the key without refraction to the total incoming flux. Tt, Td and Tp were obtained through use of an integrating sphere type measuring device. The haze H was expressed as the ratio of the diffuse transmittance Td to the total light transmittance Tt (H=Td/Tt×100), and the coordinates x, y were used as chromaticity coordinates specifying the hue in an XYZ color system. The observation was conducted twice in regard to each of the sample points W1 to W8.

TABLE 1

[Result of Measurement of Light transmittance and Haze H of White Keys 2]

| Sample Point | Measurement No. | Tt | Td | Tp | H |
|---|---|---|---|---|---|
| W1 | 1 | 13.90% | 11.90% | 2.00% | 85.61% |
| | 2 | 14.10% | 12.10% | 2.00% | 85.82% |
| W2 | 3 | 22.80% | 19.70% | 3.10% | 86.40% |
| | 4 | 22.90% | 19.80% | 3.10% | 86.46% |
| W3 | 5 | 16.20% | 13.90% | 2.30% | 85.80% |
| | 6 | 16.40% | 14.20% | 2.20% | 86.59% |
| W4 | 7 | 18.00% | 15.50% | 2.50% | 86.11% |
| | 8 | 18.20% | 15.70% | 2.50% | 86.26% |
| W5 | 9 | 20.90% | 18.00% | 2.90% | 86.12% |
| | 10 | 21.00% | 18.10% | 2.90% | 86.19% |
| W6 | 11 | 9.20% | 8.00% | 1.20% | 86.96% |
| | 12 | 9.30% | 8.10% | 1.20% | 87.10% |
| W7 | 13 | 18.00% | 15.50% | 2.50% | 86.11% |
| | 14 | 18.00% | 15.60% | 2.40% | 86.67% |
| W8 | 15 | 9.50% | 8.20% | 1.30% | 86.32% |
| | 16 | 9.90% | 8.60% | 1.30% | 86.87% |

Figure 4:
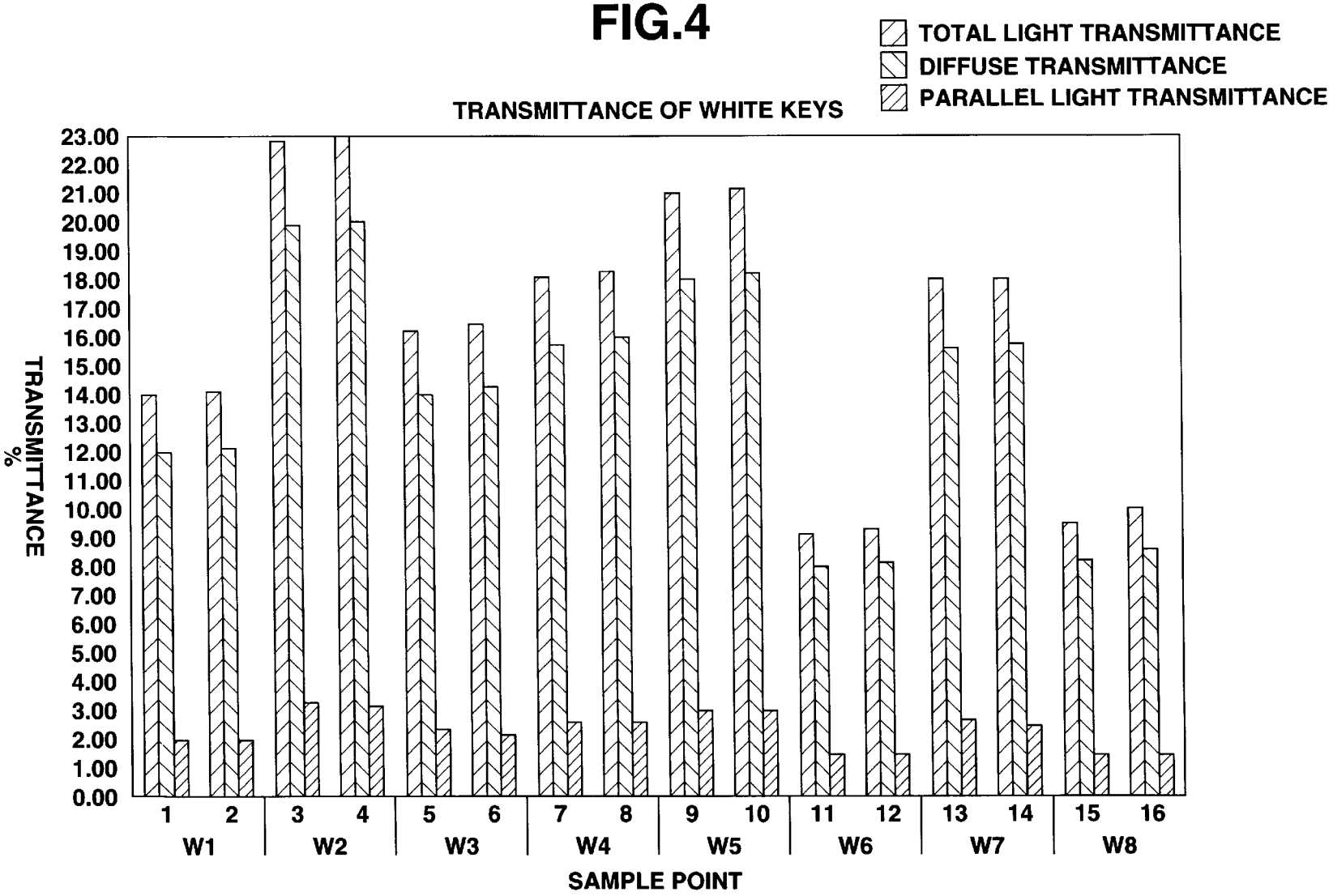
FIG. 4 is a diagram showing the light transmittance at each of sample points depicted in FIG. 3.
Figure 5:
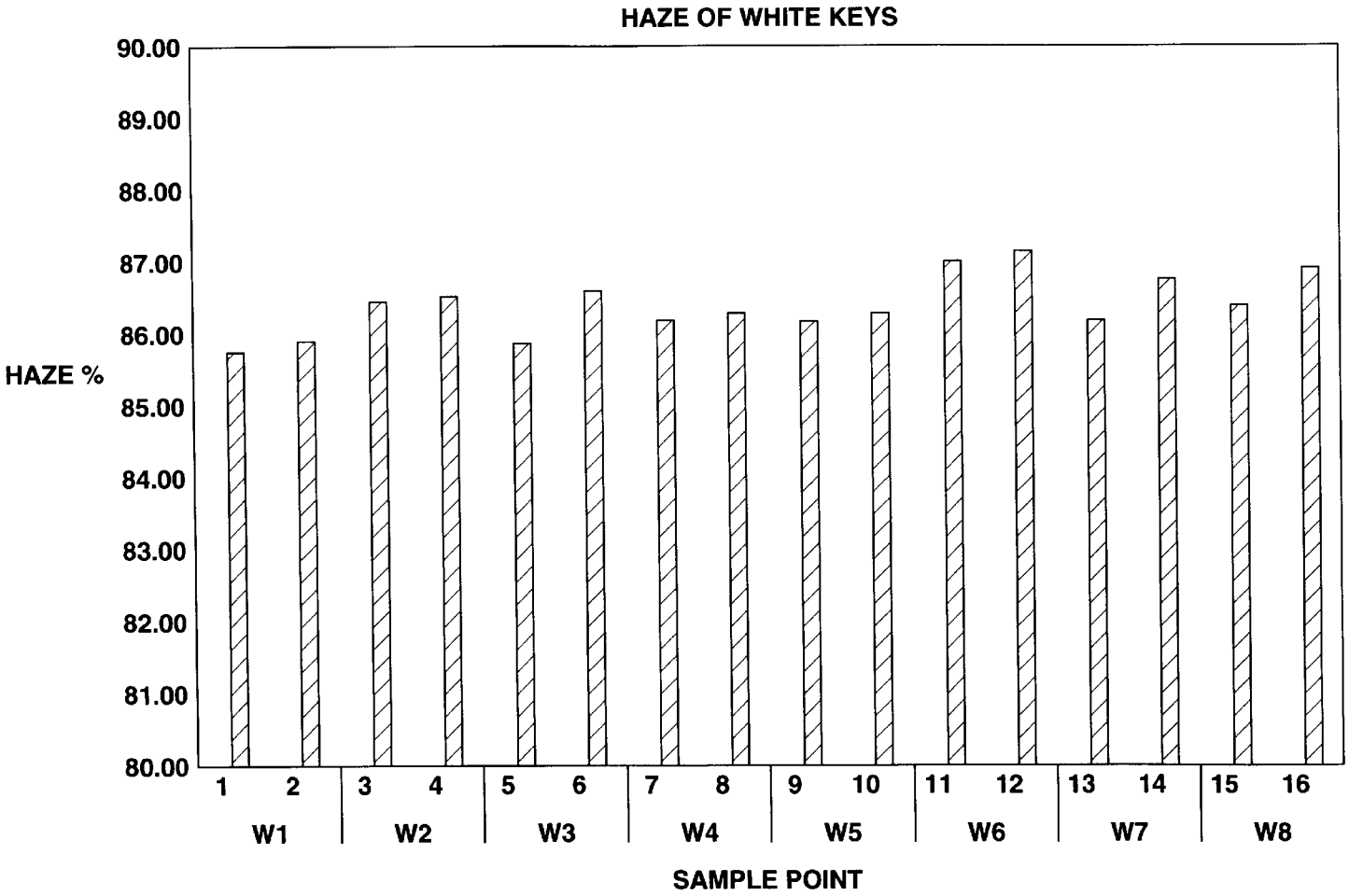
FIG. 5 is a diagram showing the haze at each of the sample points depicted in FIG. 3.

From the measurement results presented in Table 1, a graph showing the light transmittance of the white keys 2 at each of the sample points W1 to W8 is obtained as demonstrated in FIG. 4. It can be understood from FIG. 4 that the transmittances at the sample points W2, W4, W5 and W7 are relatively high. Furthermore, a graph showing the haze H of the white keys 2 at each of the sample points W1 to W8 is as demonstrated in FIG. 5, from which drawing it can be understood that the sample points W1 to W8 are substantially the same as each other in terms of the haze H, and do not significantly differ from each other in terms of the degree of diffusion depending on the amount of added light scattering agent.

TABLE 2

[Result of Measurement of XYZ Color System for White keys 2]

| Sample Point | Measurement No. | X | Y | Z | x | y |
|---|---|---|---|---|---|---|
| W1 | 1 | 64.98 | 66.02 | 83.50 | 0.303 | 0.308 |
| | 2 | 64.70 | 65.76 | 82.88 | 0.303 | 0.308 |
| W2 | 3 | 53.91 | 54.77 | 71.72 | 0.299 | 0.304 |
| | 4 | 53.42 | 54.29 | 70.89 | 0.299 | 0.304 |
| W3 | 5 | 67.90 | 69.68 | 83.03 | 0.308 | 0.316 |
| | 6 | 67.59 | 69.39 | 82.64 | 0.308 | 0.316 |
| W4 | 7 | 63.78 | 65.24 | 80.15 | 0.305 | 0.312 |
| | 8 | 63.15 | 64.56 | 79.54 | 0.305 | 0.312 |
| W5 | 9 | 65.06 | 66.72 | 80.54 | 0.306 | 0.314 |
| | 10 | 64.95 | 66.61 | 80.47 | 0.306 | 0.314 |
| W6 | 11 | 61.64 | 62.99 | 73.41 | 0.311 | 0.318 |
| | 12 | 61.59 | 62.90 | 73.56 | 0.311 | 0.318 |
| W7 | 13 | 52.49 | 54.34 | 63.55 | 0.308 | 0.319 |
| | 14 | 52.31 | 54.16 | 63.24 | 0.308 | 0.319 |
| W8 | 15 | 62.87 | 64.48 | 74.03 | 0.312 | 0.320 |
| | 16 | 62.36 | 63.96 | 73.40 | 0.312 | 0.320 |

Figure 6:
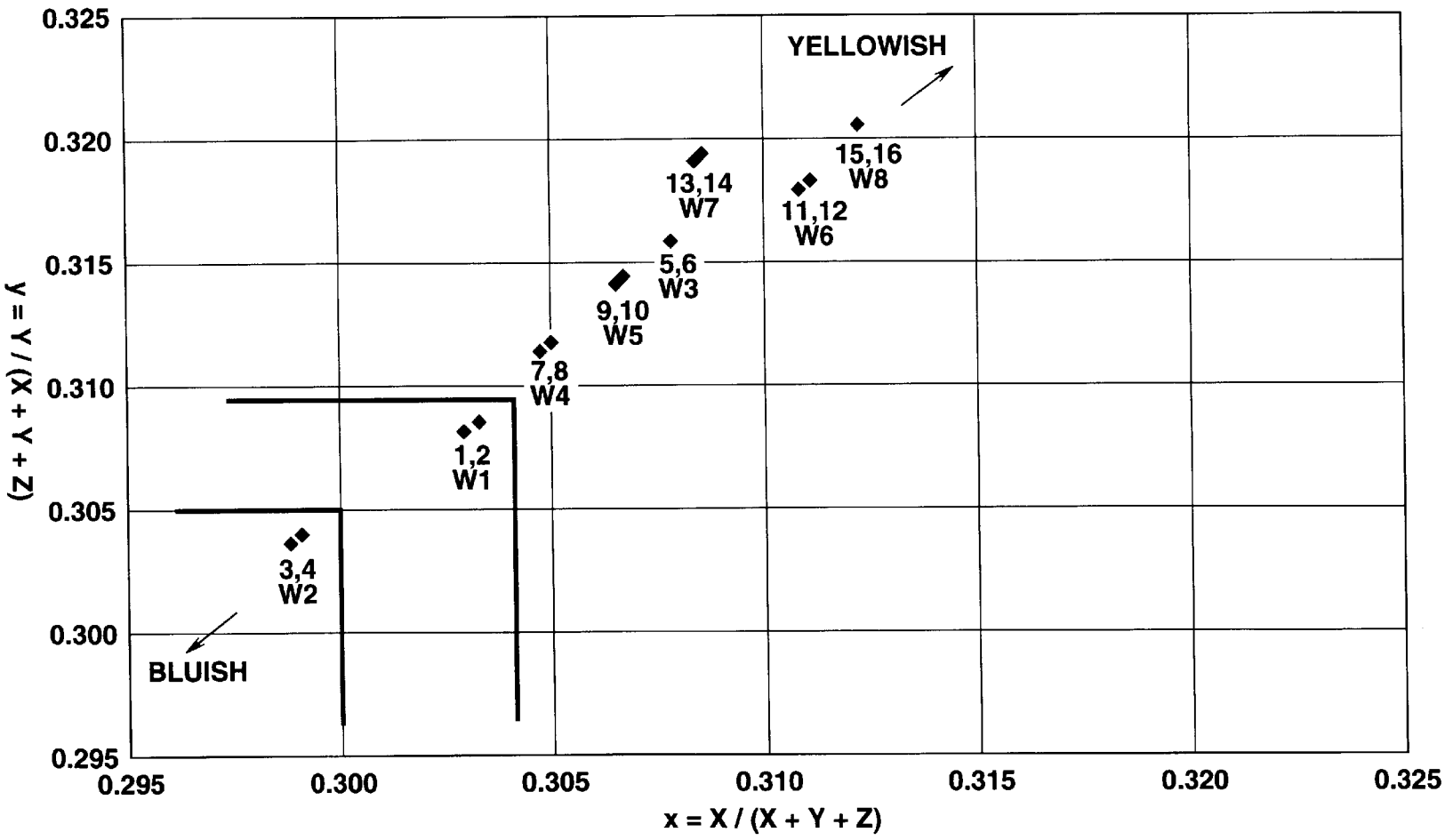
FIG. 6 is a diagram in which the hue at each of the sample points depicted in FIG. 3 is expressed as chromaticity coordinates x, y in an XYZ color system.

From the results presented in Table 2, a graph showing the hue of the white keys 2 at the chromaticity coordinates x, y is obtained as demonstrated in FIG. 6, in which the lower left portion of the graph corresponds to a range wherein bluish white is attained, while the upper left portion of the graph corresponds to a range wherein yellowish white is attained, from which it can be understood that bluish white is attained at the same point W2, whereas pale-bluish white is attained at other sample points.

TABLE 3

[Result of Measurement of L*a*b Color System for White Keys 2]

| Sample Point | Measurement No. | L | a | b |
|---|---|---|---|---|
| W1 | 1 | 81.25 | 0.56 | −3.98 |
| | 2 | 81.09 | 0.51 | −3.84 |
| W2 | 3 | 74.00 | 0.54 | −5.66 |
| | 4 | 73.68 | 0.47 | −5.47 |
| W3 | 5 | 83.48 | −0.90 | −0.54 |
| | 6 | 83.30 | −0.94 | −0.51 |
| W4 | 7 | 80.76 | −0.38 | −2.31 |
| | 8 | 80.35 | −0.32 | −2.45 |
| W5 | 9 | 81.68 | −0.78 | −1.28 |
| | 10 | 81.62 | −0.77 | −1.33 |
| W6 | 11 | 79.36 | −0.24 | 0.71 |
| | 12 | 79.31 | −0.17 | 0.53 |
| W7 | 13 | 73.72 | −1.90 | 0.49 |
| | 14 | 73.59 | −1.91 | 0.56 |
| W8 | 15 | 80.30 | −0.76 | 1.55 |
| | 16 | 79.98 | −0.77 | 1.57 |

Figure 7:
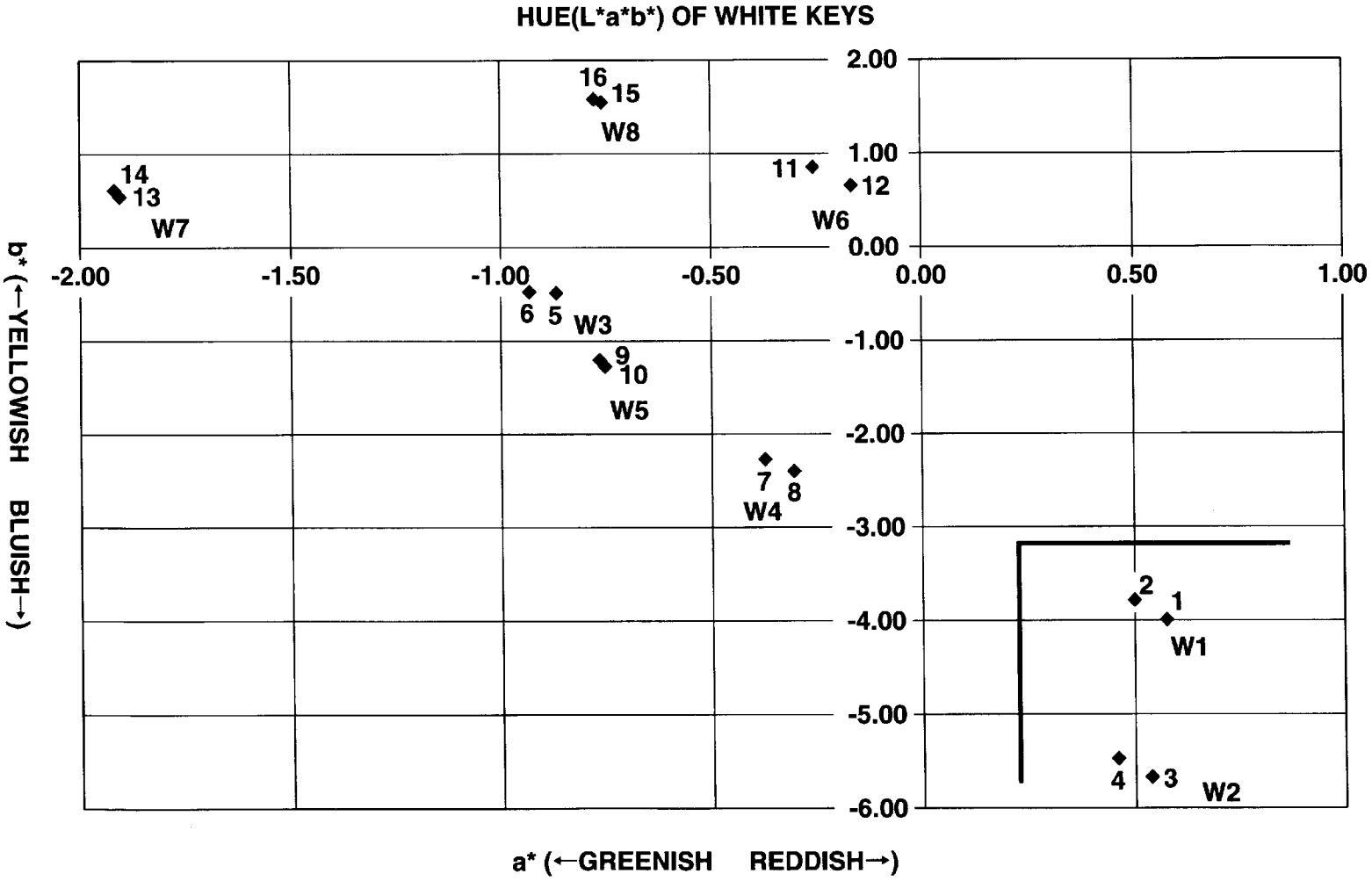
FIG. 7 is a diagram in which the hue at each of the sample points depicted in FIG. 3 is expressed as chromaticity coordinates a*, b* in an L*a*b color system.

From the results presented in Table 3, a graph showing the hue of the white keys 2 at the chromaticity coordinates a*, b* is obtained as demonstrated in FIG. 7, in which the lower left portion of the graph corresponds to a range wherein bluish white is attained, while the upper right portion of the graph corresponds to a range wherein yellowish white is attained, from which it can be understood that bluish white is attained at the sample points W1 and W2, whereas yellowish white is attained at the sample points W3, W5 and W8.

Based on the measurement results presented above, the hiding power of the pigment, or titanium oxide, is high. As the amount of added titanium oxide is increased, the transmission of light becomes difficult. If the pigment of an amount on or above the straight line A1—A1 shown in FIG. 3 is added, satisfactorily high transmittance cannot be attained. In contrast, as the amount of added pigment is decreased in consideration of the transmittance, the degree of whiteness of the white keys 2 becomes low. If the pigment of an amount on or below the straight line B1—B1 shown in FIG. 3 is added, the surface color of the white keys 2 will be unrefined. The reason the line B1—B1 slopes down rightward is that not only the pigment, but also the light scattering agent has the coloring effect in some degree; the larger amount of light scattering agent, the deeper surface color when the amount of pigment is unchanged. Moreover, as regards the light scattering agent, the degree of diffusion does not considerably differ depending on the amount of added light scattering agent, since the pigment has the light scattering effect as well. However, if the amount of added light scattering agent is excessively small, the diffusion of light does not occur and the light emitters 11 can be viewed as they are through the keys 2. Hence, the light scattering agent of an amount on or above the straight line C1—C1 shown in FIG. 3 is required. In addition, the light scattering agent has the coloring effect of yellowing white, and therefore if the light scattering agent of only the minimum necessary amount is added, its effect will be unsatisfactory, and the white keys 2 will be dark-bluish white. The "whiteness" of the white keys 2 which is discussed herein indicates a chromatic element such as "bluish" or "yellowish" white, in addition to the darkness or lightness of color, and yellowish white is generally favored.

Taking the above-described matters into consideration, the white keys 2 which are preferred in all respects, i.e., the transmittance, the haze and the hue, can be attained if the following conditions for the white keys 2 are satisfied: the transmittance is 6% or higher and is preferably within a range of 8% to 23%; the haze representing the degree of cloudiness due to the diffusion of light is 70% or higher and is preferably within a range of 81% to 88%; the coordinate x of the chromaticity coordinates x, y in the XYZ color system is 0.300 or greater and is preferably within a range of 0.303 to 0.315, while the chromaticity coordinate y is 0.303 or greater and is preferably within a range of 0.308 to 0.325. Of the sample points W1 to W8, the sample point W5 is the optimum point which satisfies the above-described conditions, however, the composition needs only satisfy the conditions falling within the hatched range in the vicinity of the sample point W5 in FIG. 3.

The black keys 3 will now be described with reference to FIGS. 8 to 12.

Figure 8:
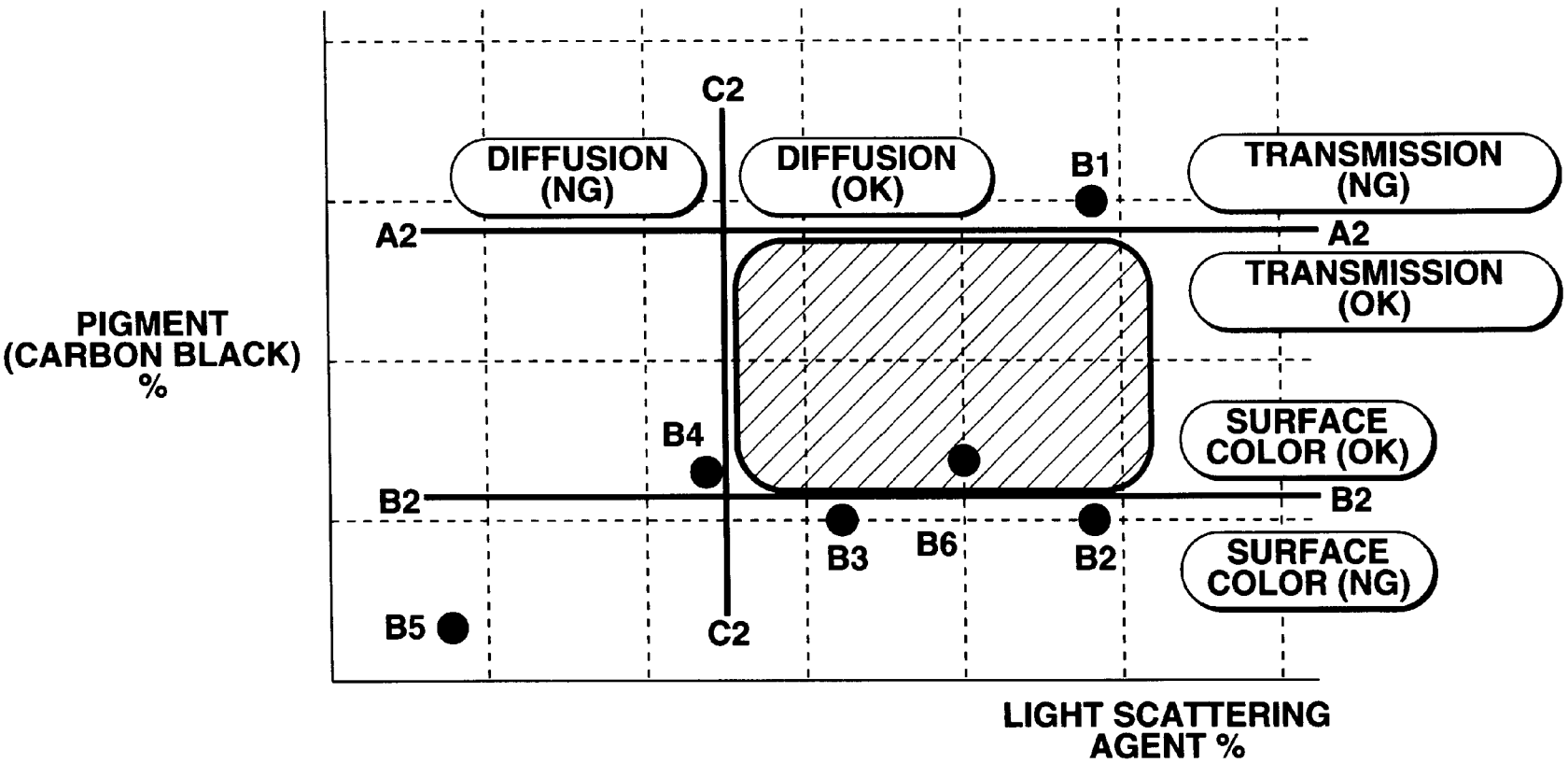
FIG. 8 is a diagram demonstrating the composition of the mixture of a pigment and a light scattering agent for the black keys illustrated in FIG. 2.

FIG. 8 demonstrates the composition of the mixture of the pigment and the light scattering agent for the black keys 3, and shows the relationship between the amount (%) of added light scattering agent which is plotted against the axis of abscissas, and the amount (%) of added pigment (carbon black) which is plotted against the axis of ordinates. In FIG. 8, given points B1 to B6 were selected as the sample points, and the light transmittance, the haze (the value representing the degree of cloudiness due to the diffusion of light) and the hue were measured at the sample points B1 to B6. Similarly in this case, the light transmittance was observed in terms of the light transmittance Tt (=Td+Tp), the diffuse transmittance Td and the parallel light transmittance Tp, the haze H was expressed as the ratio of the diffuse transmittance Td to the total light transmittance Tt (H=Td/Tt×100), and the coordinates x, y were used as chromaticity coordinates showing the hue in the XYZ color system. The observation was conducted twice in regard to each of the sample points B1 to B6.

TABLE 4

[Result of Measurement of Light transmittance and Haze of Black Keys 3]

| Sample Point | Measurement No. | Tt | Td | Tp | H |
|---|---|---|---|---|---|
| B1 | 1 | 0.10% | 0.10% | 0.00% | 100.00% |
| | 2 | 0.10% | 0.10% | 0.00% | 100.00% |
| B2 | 3 | 16.70% | 14.50% | 2.20% | 86.83%. |
| | 4 | 16.70% | 14.50% | 2.20% | 86.83% |
| B3 | 5 | 3.20% | 2.80% | 0.40% | 87.50% |
| | 6 | 3.40% | 3.00% | 0.40% | 88.24% |
| B4 | 7 | 3.80% | 3.30% | 0.50% | 86.84% |
| | 8 | 4.00% | 3.40% | 0.60% | 85.00% |
| B5 | 9 | 30.10% | 23.40% | 6.70% | 77.74% |
| | 10 | 30.40% | 23.60% | 6.80% | 77.63% |
| B6 | 11 | 6.70% | 5.80% | 0.90% | 86.57% |
| | 12 | 6.80% | 5.90% | 0.90% | 86.76% |

Figure 9:
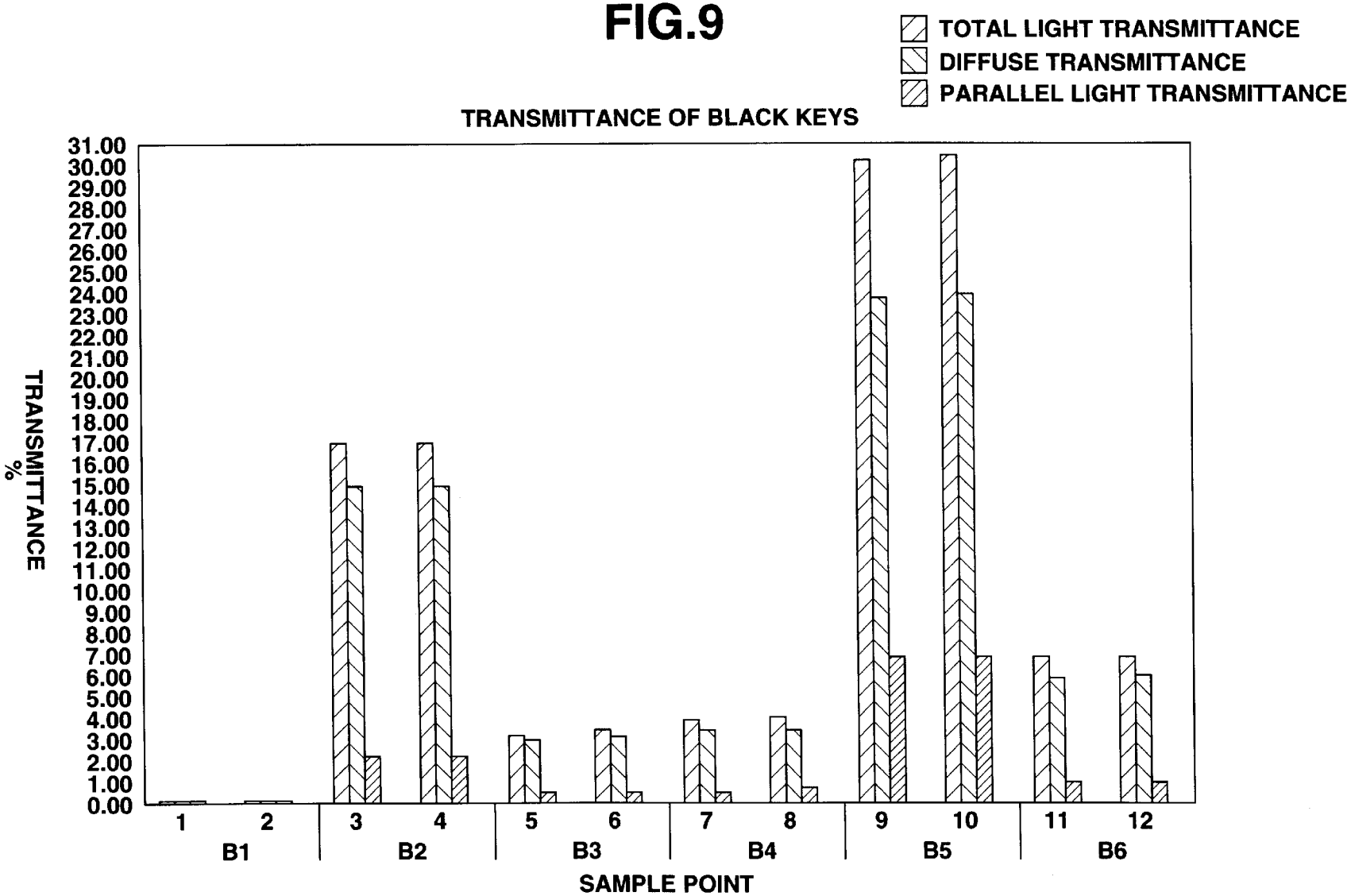
FIG. 9 is a diagram showing the light transmittance at each of sample points depicted in FIG. 8.
Figure 10:
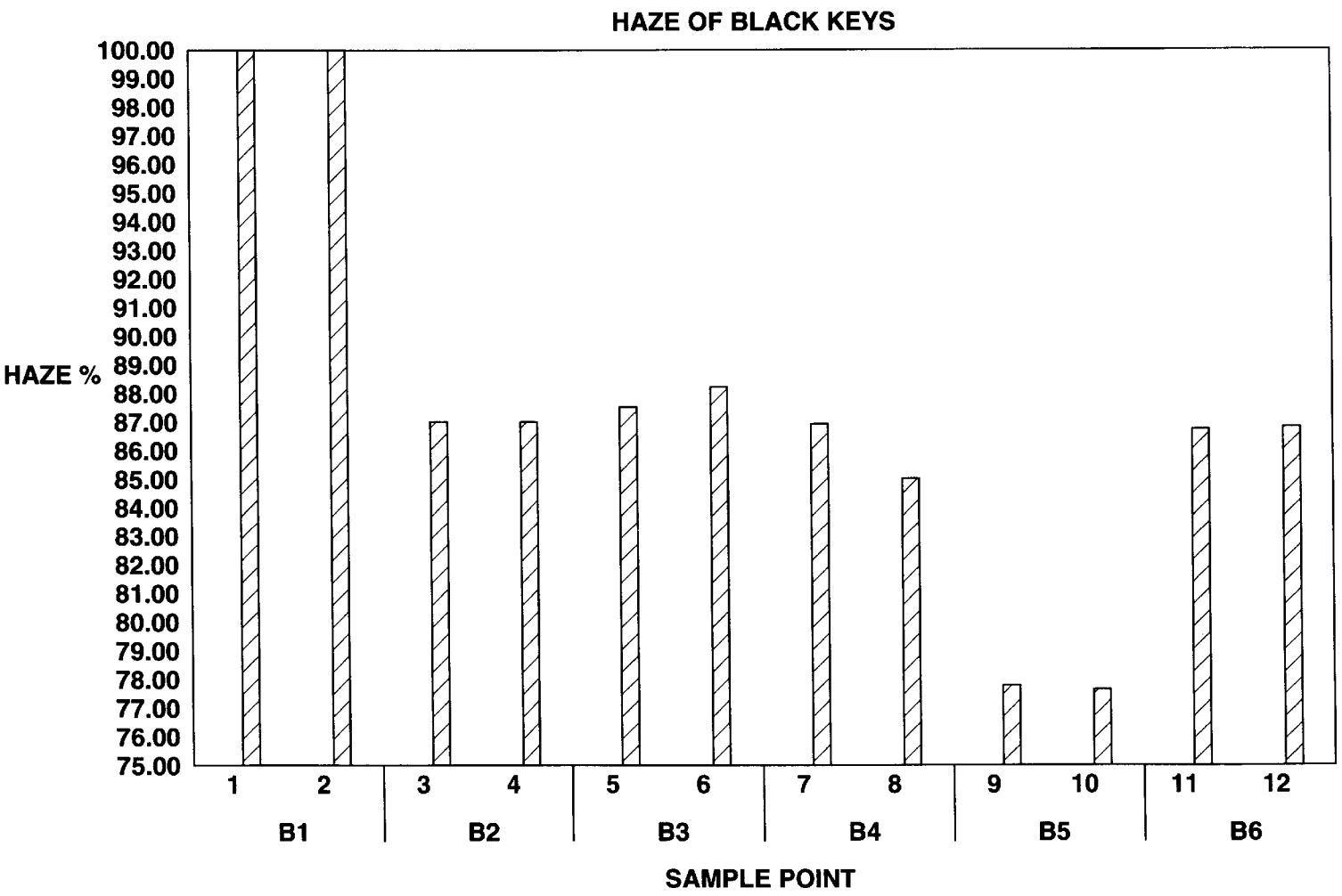
FIG. 10 is a diagram showing the haze at each of the sample points depicted in FIG. 8.

From the measurements results presented in Table 4, a graph showing the light transmittance of the black keys 3 at each of the sample points B1 to B6 is obtained as demonstrated in FIG. 9. From FIG. 9, it can be understood that the transmittance at the sample points B1 is lowest and other sample points are preferable. Furthermore, a graph showing the haze H of the black keys 3 at each of the sample points B1 to B6 is obtained as demonstrated in FIG. 10. From FIG. 10, it can be understood that the light diffusing effect at the sample point B5 is lowest and other sample points are preferable. As seen from this result, the sample points which satisfy both the transmittance and haze are B2, B3 and B6.

TABLE 5

[Result of Measurement in XYZ Color System for Black keys 3]

| Sample Point | Measurement No. | X | Y | Z | x | y |
|---|---|---|---|---|---|---|
| B1 | 1 | 0.79 | 0.80 | 1.10 | 0.294 | 0.297 |
| | 2 | 0.67 | 0.68 | 0.94 | 0.293 | 0.297 |
| B2 | 3 | 1.50 | 1.51 | 1.78 | 0.313 | 0.315 |
| | 4 | 1.46 | 1.48 | 1.72 | 0.313 | 0.318 |
| B3 | 5 | 0.79 | 0.80 | 1.06 | 0.298 | 0.302 |
| | 6 | 0.72 | 0.73 | 0.97 | 0.298 | 0.302 |
| B4 | 7 | 0.70 | 0.71 | 0.95 | 0.297 | 0.301 |
| | 8 | 0.67 | 0.68 | 0.91 | 0.296 | 0.301 |
| B5 | 9 | 0.97 | 0.99 | 1.16 | 0.311 | 0.317 |
| | 10 | 0.96 | 0.98 | 1.16 | 0.310 | 0.316 |
| B6 | 11 | 1.02 | 1.03 | 1.49 | 0.288 | 0.291 |
| | 12 | 0.96 | 0.98 | 1.40 | 0.287 | 0.293 |

Figure 11:
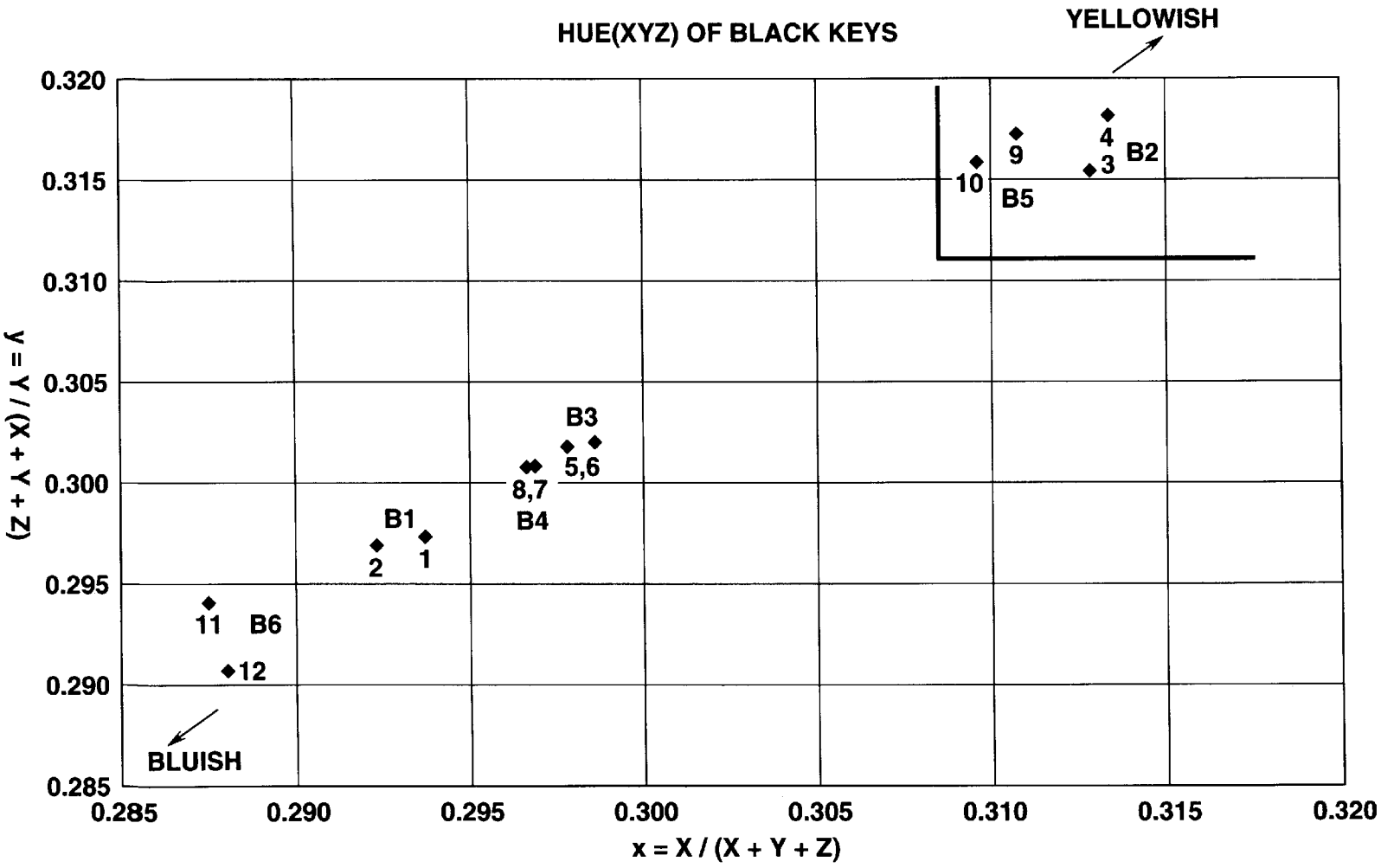
FIG. 11 is a diagram in which the hue at each of the sample points depicted in FIG. 8 is expressed as the chromaticity coordinates x, y in the XYZ color system.

From the results presented in Table 5, a graph showing the hue of the black keys 3 at the chromaticity coordinates x, y is obtained as illustrated in FIG. 11. In FIG. 11, the lower left portion of the graph corresponds to a range wherein bluish black is attained, while the upper right portion of the graph corresponds to a range wherein yellowish black is attained. From FIG. 11, it can be understood that yellowish black is attained at the sample points B2 and B5, whereas bluish black is attained at other sample points.

TABLE 6

[Result of Measurement in L*a*b Color System for Black Keys 3]

| Sample Point | Measurement No. | L | a | b |
|---|---|---|---|---|
| B1 | 1 | 8.96 | −0.02 | −0.98 |
| | 2 | 8.26 | 0.04 | −0.95 |
| B2 | 3 | 12.31 | 0.19 | 0.05 |
| | 4 | 12.15 | 0.25 | 0.13 |
| B3 | 5 | 8.93 | 0.17 | −0.80 |
| | 6 | 8.56 | 0.12 | −0.74 |
| B4 | 7 | 8.45 | 0.05 | −0.72 |
| | 8 | 8.27 | 0.08 | −0.76 |
| B5 | 9 | 9.95 | −0.10 | 0.02 |
| | 10 | 9.90 | −0.03 | 0.00 |
| B6 | 11 | 10.15 | 0.09 | −1.59 |
| | 12 | 9.88 | 0.14 | −1.49 |

Figure 12:
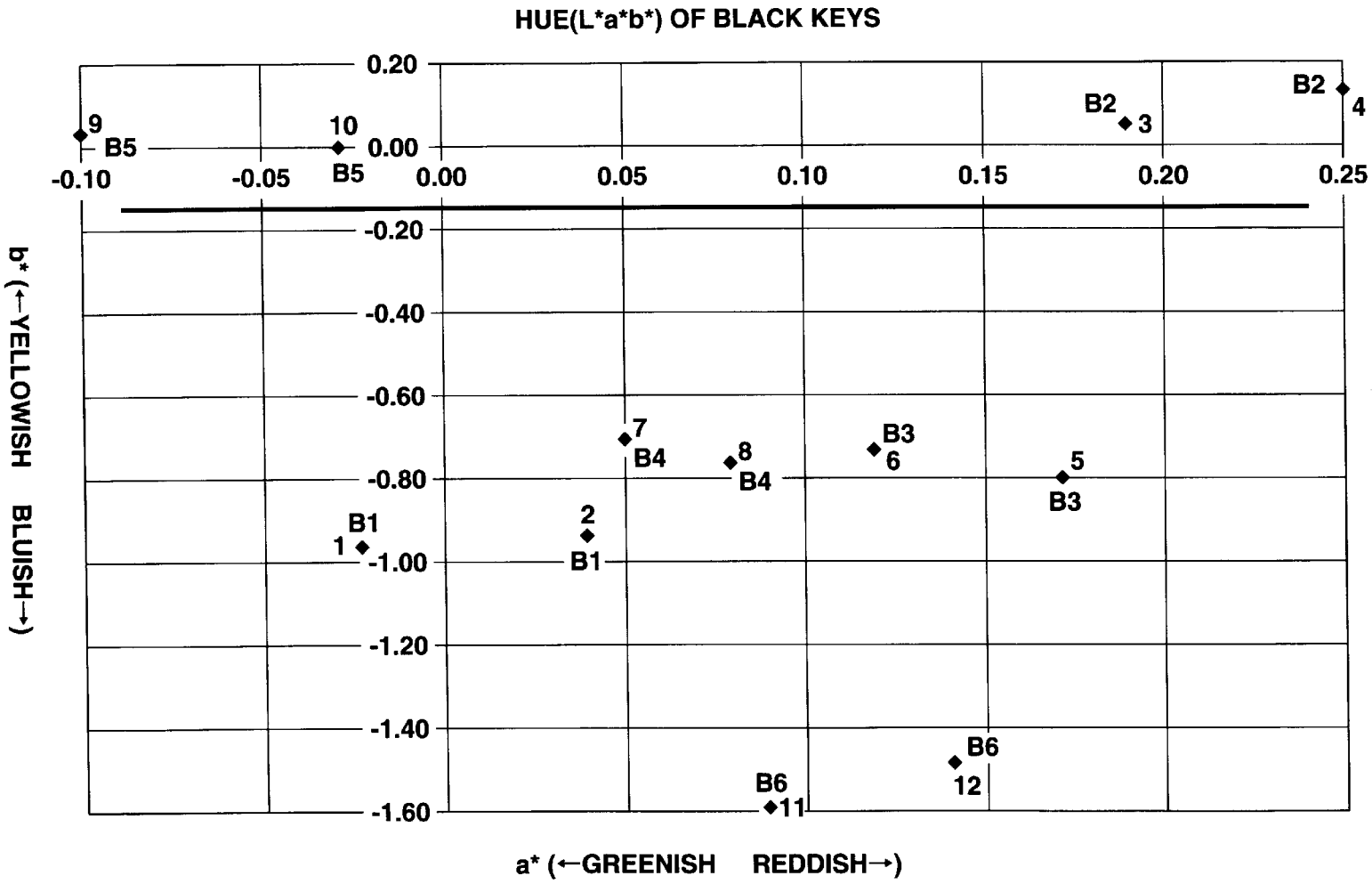
FIG. 12 is a diagram in which the hue at each of the sample points depicted in FIG. 8 is expressed in the chromaticity coordinates a*, b* in the L*a*b color system.

From the results presented in Table 6, a graph showing the hue of the black keys 3 at the chromaticity coordinates a*, b* is obtained as illustrated in FIG. 12. In FIG. 12, the upper portion of the graph corresponds to a range wherein yellowish black is attained, while the lower portion of the graph corresponds to a range wherein bluish black is attained. From FIG. 12, it can be understood that yellowish black is attained at the sample points B2 and B5, whereas bluish black is attained at other sample points.

Based on the measurement results presented above, as the amount of added pigment, or carbon black, is increased in the black keys 3, the transmission of light becomes difficult as in the case of the white keys 2. If the pigment of an amount on or above the straight line A2—A2 shown in FIG. 8 is added, satisfactorily high transmittance cannot be attained. In contrast, as the amount of added pigment is decreased in consideration of the transmittance, the degree of blackness of the black keys 3 becomes low. If the pigment of an amount on or below the straight line B2—B2 shown in FIG. 8 is added, the surface color will be an unrefined color which cannot be called as "black" for the black keys 3. As regards this surface color, the light scattering agent has almost no coloring effect, unlike in the case of the white keys 2, and bluish black is generally favored rather than yellowish black. Moreover, as regards the light scattering agent, if the amount of added light scattering agent is small, the diffusion of light does not occur and the light emitters 11 can be viewed as they are through the keys 3. Therefore, the light scattering agent of an amount on or above the straight line C2—C2 shown in FIG. 8 is required.

Taking the above-described matters into consideration, the black keys 3 which are preferred in all respects, i.e., the transmittance, the haze and the hue, can be attained if the following conditions for the black keys 3 are satisfied: the transmittance is 1% or higher and is preferably within a range of 1% to 18%; the haze representing the degree of cloudiness due to the diffusion of light is 70% or higher and is preferably within a range of 78% to 90%; and the coordinate x of the chromaticity coordinates x, y in the XYZ color system is 0.310 or less and is preferably within a range of 0.285 to 0.308, while the chromaticity coordinate y is 0.315 or greater and is preferably within a range of 0.285 to 0.312. Of the sample points B1 to B6, the sample point B6 is the optimum point which satisfies the above-described conditions, however, the composition needs only satisfy the conditions falling within the hatched range in the vicinity of the sample point B6 in FIG. 3.

Thus, in the case of the white keys 2 on the keyboard 4 of this electronic keyboard instrument, titanium oxide serving as a pigment to color a base resin for the white keys 2, and a light scattering agent having the light diffusion property, are added to the base resin having transparency. The transmittance is set at 6% or higher; the haze representing the degree of cloudiness due to the diffusion of light is set at 70% or higher; the coordinate x of the chromaticity coordinates x, y showing the hue in the XYZ color system is set at 0.303 or greater; the chromaticity coordinate y is set at 0.308 or greater; and the light emitters 11 for the white keys emit light of 70 luxes to illuminate the inner surfaces of the white keys 2 with the light. By virtue of adding the above pigment and light scattering agent to the base resin and setting the transmittance, etc. at the above values, a yellowish, ivory surface color which confers a refined feature on the white keys 2 can be attained, and the white keys 2 can shine uniformly without a difference in brightness when their corresponding light emitters 11 are lighted. This allows the keyboard instrument player to fully recognize even in daylight by his/her eyes that the white keys 2 shine.

Meanwhile, in the case of the black keys 3 on the keyboard 4, carbon black serving as a pigment to color a base resin for the black keys 3, and a light scattering agent having the light diffusion property, are added to the base resin having transparency. The transmittance is set at 1% or higher; the haze representing the degree of cloudiness due to the diffusion of light is set at 70% or higher; the coordinate x of the chromaticity coordinates x, y showing the hue in the XYZ color system is set at 0.310 or greater; the chromaticity coordinate y is set at 0.315 or greater; and the light emitters 12 for the black keys emit light of 12 luxes to illuminate the inner surfaces of the black keys 3 with the light. By virtue of adding the above pigment and light scattering agent to the base resin and setting the transmittance, etc. at the above values, a bluish surface color which confers a refined feature on the black keys 3 can be attained, and the black keys 3 can shine uniformly without a difference in brightness when their corresponding light emitters 12 are lighted. This permits the keyboard instrument player to fully recognize even in daylight by his/her eyes that the black keys 3 shine.

Therefore, according to the electronic keyboard instrument employing such white and black keys 2 and 3, when the keyboard instrument player practices playing the instrument through utilization of the navigator function, the light emitters 11 and 12 for the white and black keys are lighted such that the white and black keys 2 and 3 shine satisfactorily, teaching which keys are to be depressed assuredly in a reliable manner.

In the above-described embodiment, thin portions 2*a* and 3*a* are formed at the proximal ends of the white and black keys 2 and 3 so as to be coupled to the common coupling portions 2*b* and 3*b*, whereby the white keys 2 and the black keys 3 are formed in integration with each other to provide a keyboard with a simple key-integrated structure. However, the present invention is not limited to this embodiment and is also applicable to, for example, a keyboard in which support shafts are provided on the keyboard chassis, the white keys 2 and 3 are attached to the support shafts so as to be pivotable independently from each other, hammer arms are attached to those portions of the keyboard chassis which correspond to the white and black keys 2 and 3, and the hammer arms apply an action load to the white and black keys 2 and 3, in order to attain a key touch similar to that of an acoustic piano at the time of the key depression.

The entire disclosure of Japanese Patent Application No. H10-291311, filed Sep. 30, 1998 and including specification, claims, drawings and summary, are incorporated herein by reference in its entirety.

What is claimed is:

1. A musical keyboard instrument having a plurality of white keys and a plurality of black keys and a plurality of light emitters arranged under the plurality of white and black keys, said musical keyboard instrument being capable of selectively causing the plurality of light emitters to emit light to thereby teach which keys are to be depressed;

wherein each of the plurality of white and black keys comprises a transparent base resin colored with a pigment, and a light scattering agent having a light diffusion property such that each of the plurality of black keys has a transmittance which is set lower than a transmittance of each of the plurality of white keys; and wherein an illuminance of light for irradiating the white keys from the light emitters under the white keys is higher than an illuminance of light for irradiating the black keys from the light emitters under the black keys.

2. The keyboard according to claim 1, wherein the plurality of white keys each have a transmittance set at 6% or higher, and the plurality of black keys each have a transmittance set at 1% or higher.

3. The keyboard according to claim 1, wherein each of the plurality of white and black keys has a haze of 70% or higher which represents a degree of cloudiness due to a diffusion of light.

4. The keyboard according to claim 1, wherein each of the white keys has a hue which is specified by a chromaticity coordinate x of 0.303 or greater and a chromaticity coordinate y of 0.308 or greater in an XYZ color system, and each of the black keys has a hue which is specified by a chromaticity coordinate x of 0.310 or greater and a chromaticity coordinate y of 0.315 or greater.

5. The keyboard according to claim 1, wherein each of the light emitters arranged under the white keys has an illuminance equal to or higher than 70 luxes, and each of the light emitters arranged under the black keys has an illuminance equal to or higher than 12 luxes.

6. The keyboard musical instrument according to claim 1, wherein the illuminance of light for irradiating the white keys is equal to or higher than 70 luxes, and the illuminance of light for irradiating the black keys is equal to or higher than 12 luxes but lower than the illuminance of light for irradiating the white keys.

7. The keyboard musical instrument according to claim 1, wherein the illuminance of light for irradiating the white keys is higher than the illuminance of light for irradiating the black keys, in a manner such that a player is enabled to recognize even in daylight that the white and black keys shine.

* * * * *